US010809008B2

(12) United States Patent
Small et al.

(10) Patent No.: US 10,809,008 B2
(45) Date of Patent: Oct. 20, 2020

(54) COMPRESSOR SYSTEMS AND HEAT EXCHANGERS

(71) Applicant: Ingersoll-Rand Company, Davidson, NC (US)

(72) Inventors: Robert Small, Williamsville, NY (US); Dominic Bochicchio, Concord, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 15/970,531

(22) Filed: May 3, 2018

(65) Prior Publication Data

US 2019/0339015 A1 Nov. 7, 2019

(51) Int. Cl.

| | |
|---|---|
| ***F28D 7/16*** | (2006.01) |
| ***F04D 29/58*** | (2006.01) |
| *F28F 9/18* | (2006.01) |
| *F28F 9/22* | (2006.01) |

(52) U.S. Cl.

CPC ..... *F28D 7/1661* (2013.01); *F04D 29/5826* (2013.01); *F05B 2260/211* (2013.01); *F28F 9/182* (2013.01); *F28F 2009/224* (2013.01); *F28F 2250/106* (2013.01)

(58) Field of Classification Search

CPC ..... F28D 7/1661; F28D 7/1653; F28D 7/163; F04D 29/5826; F04C 29/04; F04C 23/001

USPC ..... 165/157

See application file for complete search history.

(56) References Cited

U.S. PATENT DOCUMENTS

| | | | | |
|---|---|---|---|---|
| 3,168,136 | A | 2/1965 | Ammon | |
| 5,511,613 | A | 4/1996 | Mohn et al. | |
| 7,614,443 | B2 | 11/2009 | Usui et al. | |
| 2003/0010479 | A1* | 1/2003 | Hayashi | F01N 5/02 165/157 |
| 2003/0111211 | A1* | 6/2003 | Stonehouse | F01N 3/043 165/103 |
| 2011/0036098 | A1* | 2/2011 | Baten | F02C 7/143 60/806 |
| 2013/0089413 | A1* | 4/2013 | Fujimoto | F04C 29/04 415/177 |
| 2014/0262172 | A1 | 9/2014 | Ljubicic | |
| 2014/0311721 | A1 | 10/2014 | Esformes et al. | |
| 2016/0187893 | A1* | 6/2016 | Bergh | G05D 16/2073 137/14 |
| 2017/0167797 | A1* | 6/2017 | Tomioka | F28F 9/00 |

FOREIGN PATENT DOCUMENTS

CN 107763900 A * 3/2018

* cited by examiner

*Primary Examiner* — Tho V Duong
(74) *Attorney, Agent, or Firm* — Taft Stettinius & Hollister LLP

(57) ABSTRACT

A compressor system includes a compressor having a discharge port; and a shell and tube heat exchanger fluidly coupled to the discharge port. The heat exchanger includes a shell and a tube bundle disposed inside the shell. The shell includes a first flat portion extending along a longitudinal axis of the shell from a first end of the shell to a second end of the shell, and a second flat portion parallel to the first flat portion and extending along the longitudinal axis between the first end and the second end. The tube bundle is positioned between the first flat portion and the second flat portion, and extends along the longitudinal axis between the first end of the shell and the second end of the shell.

3 Claims, 4 Drawing Sheets

COMPRESSOR SYSTEMS AND HEAT EXCHANGERS

TECHNICAL FIELD

The present application generally relates to compressors and more particularly, but not exclusively, to compressor systems and heat exchangers for compressor systems.

BACKGROUND

Compressor systems with heat exchangers remain an area of interest. Some existing systems have various shortcomings, drawbacks and disadvantages relative to certain applications. For example, in some compressor systems, undesirable pressure drops through the heat exchangers may occur. Accordingly, there remains a need for further contributions in this area of technology.

SUMMARY

A compressor system includes a compressor having a discharge port; and a shell and tube heat exchanger fluidly coupled to the discharge port. The heat exchanger includes a shell and a tube bundle disposed inside the shell. The shell includes a first flat portion extending along a longitudinal axis of the shell from a first end of the shell to a second end of the shell, and a second flat portion parallel to the first flat portion and extending along the longitudinal axis between the first end and the second end. The tube bundle is positioned between the first flat portion and the second flat portion, and extends along the longitudinal axis between the first end of the shell and the second end of the shell.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
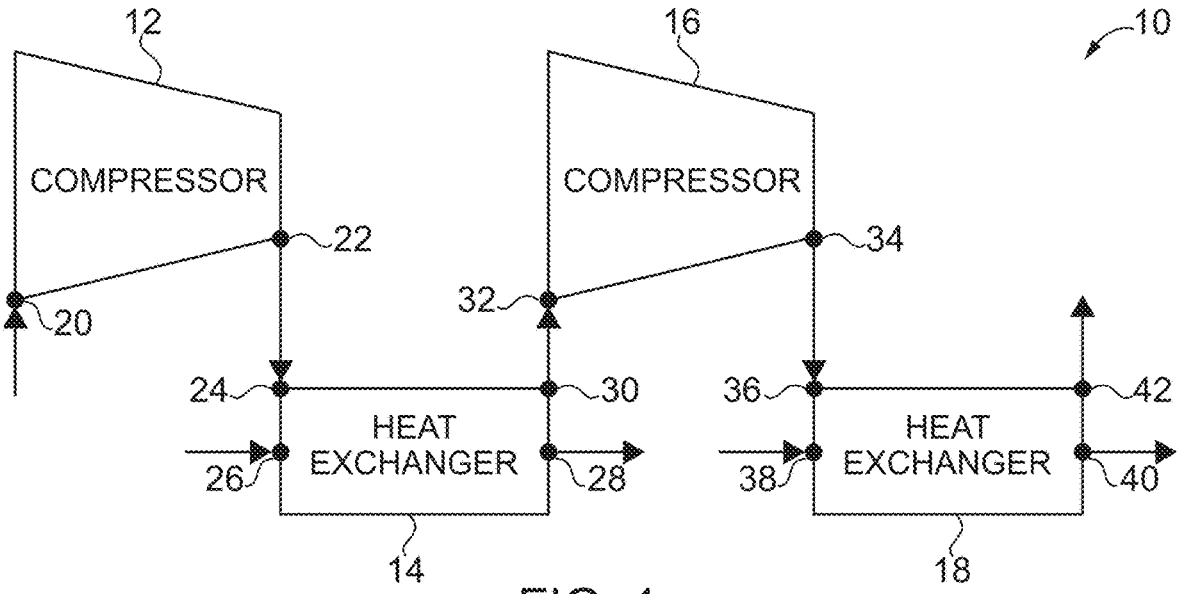
FIG. 1 schematically illustrates some aspects of a non-limiting example of a compressor system in accordance with an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, some aspects of a non-limiting example of a compressor system 10 are schematically illustrated in accordance with an embodiment of the present invention. Compressor system 10 includes a compressor 12, a heat exchanger 14, a compressor 16 and a heat exchanger 18. The number of compressors may vary with the needs of the application. For example, some embodiments may include a single compressor, and some embodiments may include a greater number of compressors. The number of heat exchangers may also vary with the needs of the application. For example, some embodiments may not include heat exchanger 18.

In one form, compressors 12 and 16 are centrifugal compressors. In other embodiments, one or both of compressors 12 and 16 may take other forms, and may be, for example, screw compressors, Roots blowers, sliding vane compressors, axial compressors or combination axial-centrifugal compressors. Compressor 12 is a low pressure compressor, and compressor 16 is a high pressure compressor, which compresses the air discharged by compressor 12. Heat exchanger 14 is an intercooler. In one form, heat exchangers 14 and 18 are shell and tube heat exchangers. In some embodiments, heat exchangers 14 and 18 may be cross-flow heat exchangers. In other embodiments, one or both of heat exchangers 14 and 18 may take other forms, and may be, for example, counter-flow heat exchangers or mixed counter-flow cross-flow heat exchangers.

Compressor 12 has an inlet port 20 for receiving a compressible fluid, such as air or another gas. Compressor 12 is operative to compress the air, and discharge the air via a discharge port 22 of compressor 12 to an inlet nozzle 24 of heat exchanger 14, e.g., via piping (not shown) that fluidly couples discharge port 22 with inlet nozzle 24. Inlet nozzle 24 is operative to supply a fluid for cooling (or heating in some embodiments) by heat exchanger 14. Heat exchanger 14 is a pressure vessel constructed to withstand compressor 12 discharge pressure. Heat exchanger 14 is operative to transfer heat from the compressed air by passing the compressed air across and through a cooling tube bundle through which a cooling fluid, e.g., water, is circulated (not shown in FIG. 1), thus cooling the air. The cooling fluid is supplied to the cooling tube bundle through a cooling fluid inlet 26 of heat exchanger 14, and is discharged from the cooling tube bundle through a cooling fluid outlet 28 of heat exchanger 14. The cooled, compressed air is discharged from heat exchanger 14 via an outlet nozzle 30, which supplies the air to an inlet port 32 of compressor 16, e.g., via pipes fluidly coupling outlet nozzle 30 to inlet port 32.

Compressor 16 is operative to compress the air that was compressed by compressor 12 and cooled by heat exchanger 14, and to discharge high pressure air via a discharge port 34 of compressor 16 to an inlet nozzle 36 of heat exchanger 18, e.g., via piping (not shown) that fluidly couples discharge port 34 with inlet nozzle 36. Inlet nozzle 36 is operative to supply a fluid or gas for cooling by heat exchanger 18. Heat exchanger 18 is a pressure vessel constructed to withstand compressor 16 discharge pressure. Heat exchanger 18 is operative to transfer heat from the air compressed by compressor 16 by passing the compressed air across and through a cooling tube bundle through which a cooling fluid, e.g., water, is circulated (not shown in FIG. 1), thus cooling the air. The cooling fluid is supplied to the cooling tube bundle through a cooling fluid inlet 38 of heat exchanger 18, and is discharged from the cooling tube bundle through a cooling fluid outlet 40 of heat exchanger 18. The cooled, compressed air is discharged from heat exchanger 18 via an outlet nozzle 42, which supplies the air to downstream process(es).

Figure 2A:
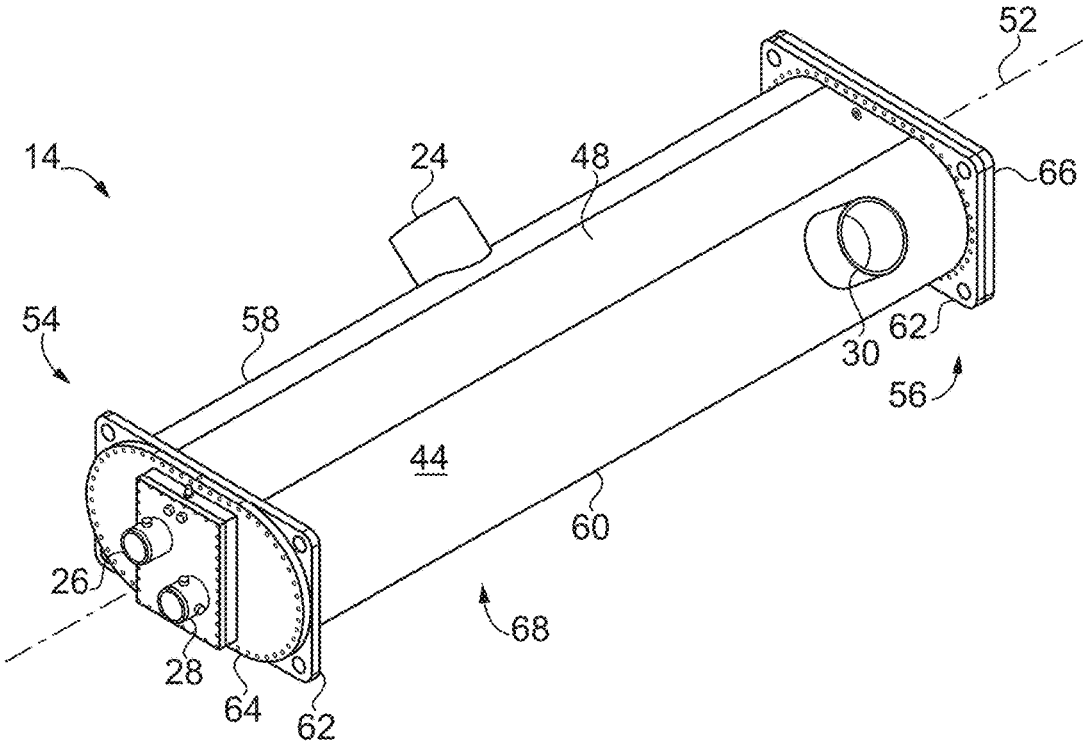
FIGS. 2A-2E schematically illustrate some aspects of a non-limiting example of a heat exchanger in accordance with an embodiment of the present invention.
Figure 2B:
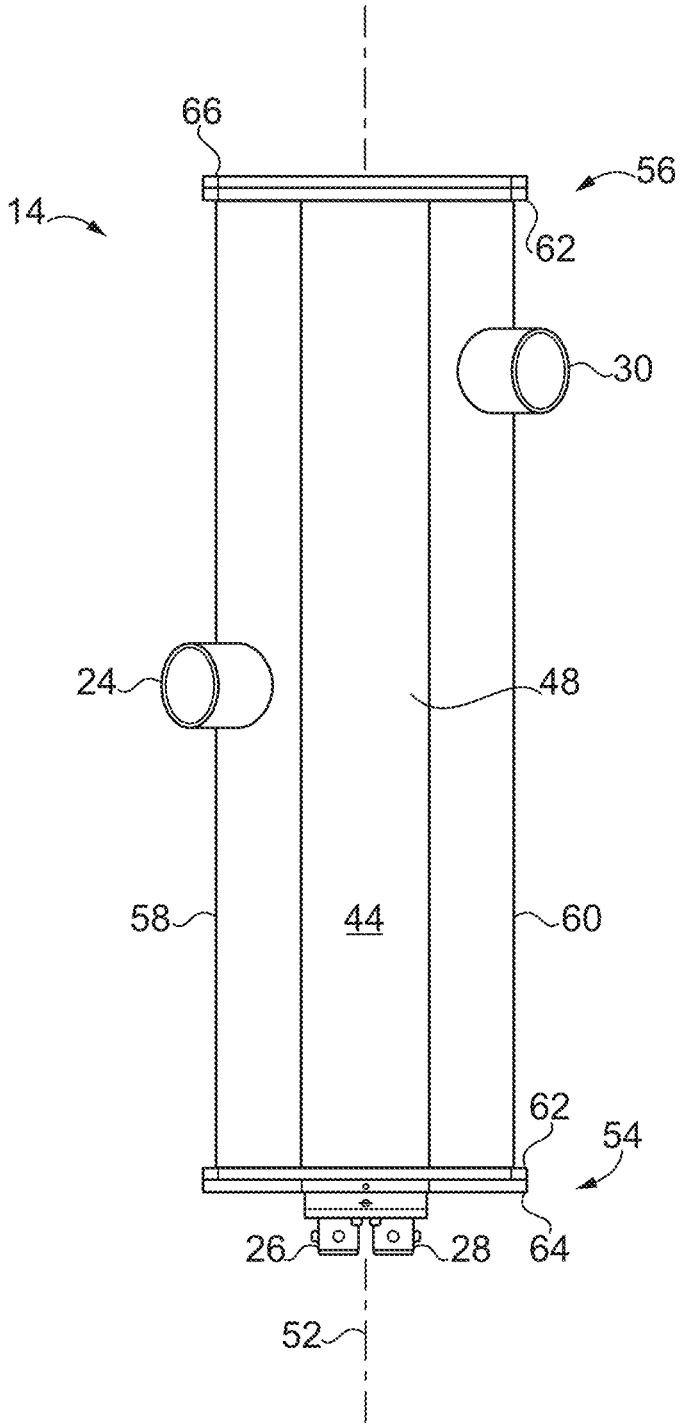
Figure 2D:
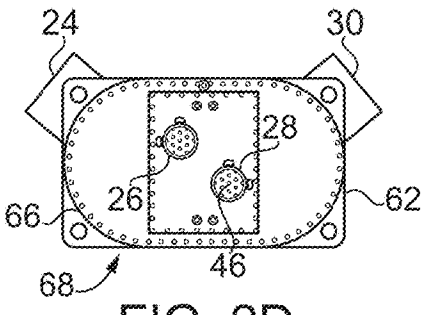
Figure 2C:
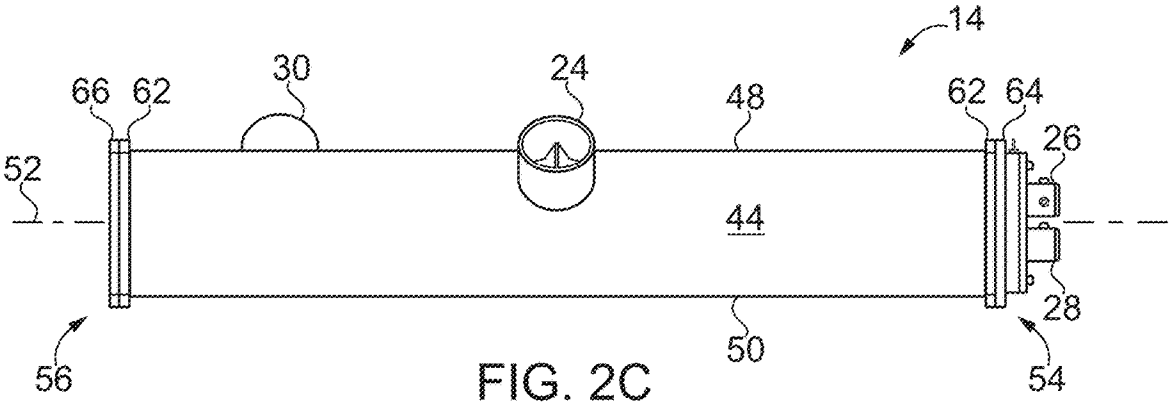
Figure 2E:
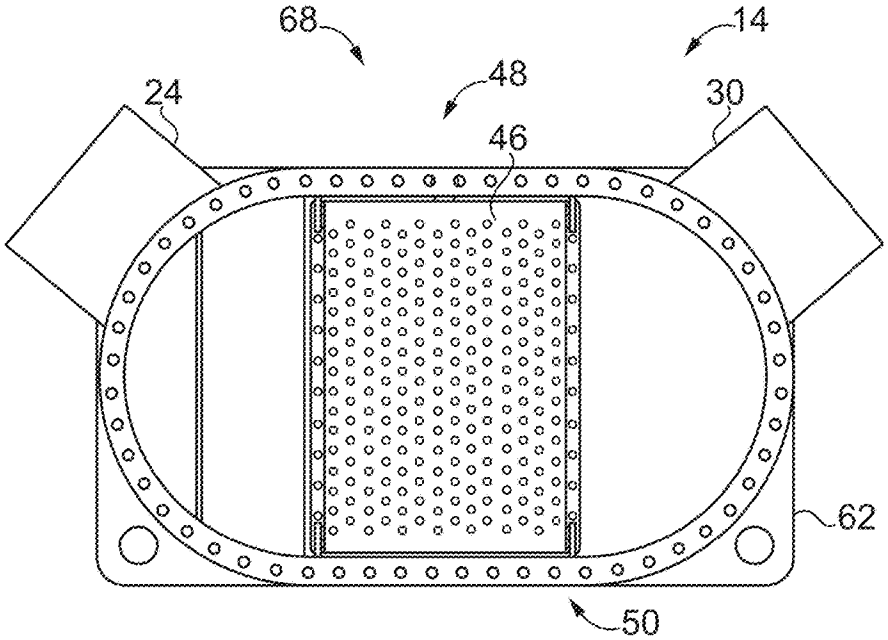

Referring to FIGS. 2A, 2B, 2C, 2D and 2E, some aspects of a non-limiting example of heat exchanger 14 in accordance with an embodiment of the present invention is illustrated. The description of heat exchanger 14 applies equally to heat exchanger 18. FIG. 2A illustrates an isometric view of heat exchanger 14, FIGS. 2B, 2C and 2D illustrate respective top, side and end views, and FIG. 2E illustrates an end view having a cover plate removed to illustrate a cooling tube bundle.

Heat exchanger 14 includes a shell 44 and a tube bundle 46 disposed inside shell 44. Shell 44 includes a flat portion 48 at the top of shell 44 and a flat portion 50 at the bottom of shell 44 that is parallel to flat portion 48. Flat portion 48 and flat portion 50 may be rectangular in shape. Flat portion 48 and flat portion 50 extend along the longitudinal axis 52 of heat exchanger 14, i.e., have their primary dimensions (i.e., major or largest dimensions) in the direction along longitudinal axis 52. Longitudinal axis 52 is the axis parallel to (or coincident with) the primary dimension (i.e., the major dimension) of heat exchanger 14. For example, the length of heat exchanger 14 extends along longitudinal axis 52, whereas the height and width of heat exchanger 14 (vertical and horizontal dimensions in FIG. 2D) extend in directions perpendicular to longitudinal axis 52. Flat portions 48 and 50 extend along longitudinal axis 52, between ends 54, 56 of shell 44, i.e., extending from end 54 to end 56 of shell 44, and in one form, the respective top and bottom of shell 44. Shell 44 includes hemispherical (i.e., half-circular cross-section or 180° of arc length) portions 58 and 60 extending between end 54 and end 56 of shell 44, i.e., extending from end 54 to end 56, which form the sides of shell 44. Hemispherical portions 58 and 60 are affixed to flat portions 48 and 50, e.g., welded to flat portions 48 and 50 along longitudinal axis 52, i.e., wherein the weld lines are parallel to longitudinal axis 52. Flat portions 48, 50 and hemispherical portions 58, 60 provide heat exchanger 14 and shell 44 with a flat oval cross-section 68 along longitudinal axis 52, i.e., a flat oval cross-section when viewed in the direction of or along longitudinal axis 52. In some embodiments, heat exchanger 14 may be oriented such that flat portions 48, 50 are disposed on the sides, and hemispherical portions 58, 60 disposed at the top and bottom.

Shell 44 includes flanges 62 at ends 54 and 56 affixed thereto, e.g., welded thereto, to which cover plates 64 and 66 are affixed, e.g., bolted. Inlet nozzle 24 is coupled or affixed to hemispherical portion 58, e.g., welded thereto. Outlet nozzle 30 is coupled or affixed to hemispherical portion 60, e.g., welded thereto.

Tube bundle 46 is disposed inside shell 44, positioned between flat portion 48 and flat portion 50, and is adjacent to, e.g., immediately adjacent to, flat portions 48, 50 (e.g., in close proximity to flat portions 48, 50, while allowing enough room to prevent an interference fit or too tight an interference fit between tube bundle 46 and shell 44, so as to allow the ready installation/removal of tube bundle 46 into/from shell 44). Tube bundle 46 extends along longitudinal axis 52 between ends 54, 56 of shell 44, i.e., extends from end 54 to end 56. In one form, tube bundle 46 has a rectangular cross-section when viewed along longitudinal axis 52. For example, in some embodiments, tube bundle 46 may have a square cross-section along longitudinal axis 52, i.e., when viewed along longitudinal axis 52. In one form, shell 44 is constructed to reflect, e.g., to approximately match, the shape of tube bundle 46. For example, in the illustrated embodiments, the width of flat portions 48, 50 (as measured from left to right in the views of FIGS. 2B, 2D and 2E) may be selected to reflect or substantially reflect the width of tube bundle 46; and the spacing between flat portions 48, 50 may be constructed to reflect or substantially reflect the height of tube bundle 46 (as measured in the vertical direction in the views of FIGS. 2B, 2D and 2E). For example, the dimensions of shell 44, e.g., the height) may be slightly larger than tube bundle 46 so as to allow tube bundle 46 to be readily installed into shell 44. In other embodiments, the dimensions of shell 44 may be approximately the same as tube bundle 46 or slightly smaller (creating an interference fit). Baffles between tube bundle 46 and shell 44 are thus not required in some embodiments. In some embodiments, baffles, e.g., relatively small baffles, may be employed. It will be understood that mounting and/or interface and/or sealing features or devices may be employed on or between tube bundle 46 and/or shell 44 in some embodiments.

Figure 3A:
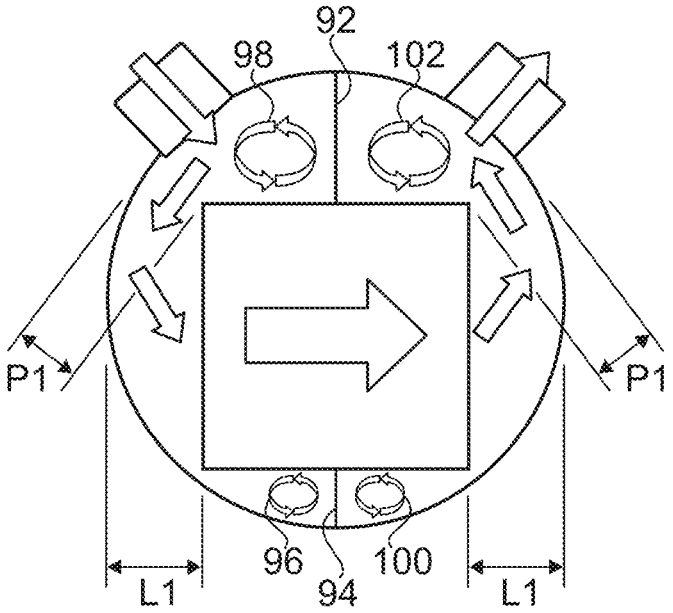
FIG. 3A schematically illustrates flow patterns in a heat exchanger having a circular cross-section.
Figure 3B:
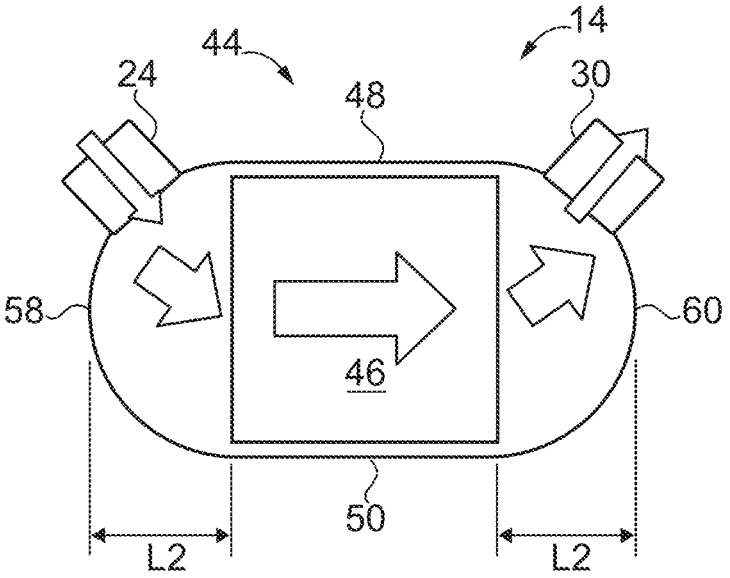
FIG. 3B illustrates flow patterns in a heat exchanger having a flat oval cross-section in accordance with an embodiment of the present invention.

Referring to FIGS. 3A and 3B, by constructing shell 44 in the form of a flat oval, pressure losses through heat exchanger 14 may be reduced. For example, assuming the same tube bundles, e.g., rectangular tube bundles, although a shell having a circular cross-section may be employed, the circular cross-section may yield higher pressure losses than a flat oval cross-section. This is particularly true where the heat exchanger inlet and outlet nozzles are located closer to the compressors, e.g., on the top portion of the heat exchanger, which is desirable because it may reduce overall package size. This is also true, regardless of where the inlet and outlet nozzles are disposed. For example, a factor in determining flow area between the inlet nozzle and the tube bundle is the horizontal distance between the side of the tube bundle and the side of the shell, given as L1 in FIG. 3A and L2 in FIG. 3B. It is seen that L2 is greater than L1. This is true, even if the circular shell is substantially larger than required to encompass the tube bundle, e.g., as illustrated in FIG. 3A, which is a common design feature in order to increase flow area to the tube bundle. The hemispherical sides of embodiments of the present invention provide greater flow area. Additional flow area may be provided by extending the width of the flat portions of the shell. Also, the flat oval shape allows the air flowing into and out of the heat exchanger a more direct path by avoiding the necessity of the air stream to "go around" the tube bundle (e.g., the corner of the tube bundle) in order to enter the tube bundle, and eliminates flow areas, e.g., represented by pinch points P1 (FIG. 3A), which are flow restrictions that cause additional pressure losses.

In addition, this use of the circular shell requires the use of large baffles, e.g., baffles 92, 94 illustrated in FIG. 3A, which are not required for the heat exchanger having a flat oval cross section, e.g., wherein the shell or the flat portions of the shell reflect the shape of the tube bundle, since the tube bundle is not spaced substantially apart from the top and bottom portions of the tube bundles. Thus, in some embodiments, no baffles are required, whereas in other embodiments, one or more small baffles may be employed. Additional pressure losses stemming from recirculation patterns 96, 98 on the hot side of the circular shell heat exchanger and recirculation patterns 100, 102 on the cold side of the circular shell heat exchanger are also avoided with the heat exchanger 14 having a flat oval shell 44 because the flat oval configuration does not form the volumes or zones in which such recirculation patterns may be set up.

Also, the use of the flat oval shell 44 allows workers who are attending to the compressor system 10 a flat surface to stand on, reducing the likelihood of slippage while standing on the heat exchanger, unlike shells having a circular cross-section. In addition, the flat oval shell configuration requires less material to form the shell, e.g., 30% less in some embodiments, as compared to a shell having a circular cross-section.

Embodiments of the present invention include a compressor system, comprising: a compressor having a discharge port; and a shell and tube heat exchanger fluidly coupled to the discharge port, the heat exchanger having a shell and a tube bundle disposed inside the shell, wherein the shell includes a first flat portion extending along a longitudinal axis of the shell from a first end of the shell to a second end of the shell, and a second flat portion parallel to the first flat portion and extending along the longitudinal axis between the first end and the second end; and wherein the tube bundle is positioned between the first flat portion and the second flat portion, and extends along the longitudinal axis between the first end of the shell and the second end of the shell.

In a refinement, the tube bundle has a rectangular cross-section perpendicular to the longitudinal axis.

In another refinement, the shell further comprises first and second hemispherical portions affixed to the first flat portion and to the second flat portion along the longitudinal axis and extending between the first and second ends of the shell.

In yet another refinement, the compressor system further comprises a heat exchanger inlet nozzle coupled to the first hemispherical portion and a heat exchanger outlet nozzle coupled to the second hemispherical portion.

In still another refinement, the shell further comprises a first end plate disposed at a first end of the shell, and a second end plate disposed at the second end of the shell.

In yet still another refinement, the compressor is operative to supply a fluid to the shell at a compressor discharge pressure, and wherein the shell is a pressure vessel constructed to withstand the compressor discharge pressure.

In a further refinement, the heat exchanger is an intercooler.

In a still further refinement, the heat exchanger has a flat oval cross-section extending along the longitudinal axis.

Embodiments of the present invention include a compressor system, comprising: a compressor having a discharge port; and a shell and tube heat exchanger fluidly coupled to the discharge port, the heat exchanger having a shell and having a tube bundle disposed inside the shell, wherein the shell has a longitudinal axis and a flat oval cross-section along the longitudinal axis; and wherein the shell is constructed to reflect a shape of the tube bundle.

In a refinement, the tube bundle has a rectangular cross-section along the longitudinal axis.

In another refinement, the shell has a first flat portion at a top of the shell, a second flat portion at the bottom of the shell, and two hemispherical portions at opposing sides of the first and second flat portions, each of the first flat portion, the second flat portion and the hemispherical portions extending along the longitudinal axis from a first end of the shell to a second end of the shell; and wherein the tube bundle is disposed adjacent to and between the first flat portion and the second flat portion, and extends from the first end to the second end.

In yet another refinement, the compressor system further comprises a heat exchanger inlet nozzle coupled to the first hemispherical portion and a heat exchanger outlet nozzle coupled to the second hemispherical portion.

In still another refinement, the shell further comprises a first end plate disposed at the first end, and a second end plate disposed at the second end.

In yet still another refinement, the compressor is operative to supply a fluid to the shell at a compressor discharge pressure, and wherein the shell is a pressure vessel constructed to withstand the compressor discharge pressure.

In a further refinement, the heat exchanger is an intercooler.

Embodiments of the present invention include a shell and tube heat exchanger, comprising: a tube bundle; and a shell, wherein the shell includes a first flat portion extending along a longitudinal axis of the shell from a first end of the shell to a second end of the shell, a second flat portion parallel to the first flat portion and extending along the longitudinal axis between the first end and the second end; and wherein the tube bundle is positioned between the first flat portion and the second flat portion, and extends along the longitudinal axis between the first end and the second end.

In a refinement, the tube bundle has a rectangular cross-section along the longitudinal axis.

In another refinement, the shell further comprises first and second hemispherical portions affixed to the first flat portion and to the second flat portion along the longitudinal axis and extending between the first and second ends of the shell.

In yet another refinement, the heat exchanger further comprises a heat exchanger inlet nozzle coupled to the first hemispherical portion and operative to supply a fluid for cooling by the heat exchanger; and a heat exchanger outlet nozzle coupled to the second hemispherical portion and operative to discharge the fluid cooled by the heat exchanger.

In still another refinement, the shell further comprises a first end plate disposed at a first end of the shell, and a second end wall disposed at the second plate of the shell.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A shell and tube heat exchanger, comprising:

a tube bundle; and a shell, wherein the shell includes a first flat portion extending along a longitudinal axis of the shell from a first end of the shell to a second end of the shell, a second flat portion parallel to the first flat portion and extending along the longitudinal axis between the first end and the second end; and wherein the tube bundle is positioned between the first flat portion and the second flat portion, and extends along the longitudinal axis between the first end and the second end;

wherein the shell further comprises first and second hemispherical portions affixed to the first flat portion and to the second flat portion along the longitudinal axis and extending between the first and second ends of the shell; and further comprising a heat exchanger inlet nozzle coupled to the first hemispherical portion and operative to supply a fluid for cooling by the shell and tube heat exchanger; and a heat exchanger outlet nozzle coupled to the second hemispherical portion and operative to discharge the fluid cooled by the shell and tube heat exchanger;

wherein the tube bundle is positioned between the first flat portion and second flat portion and does not extend into an open space defined in the first and second hemispherical portions.

2. The shell and tube heat exchanger of claim 1, wherein the tube bundle has a rectangular cross-section along the longitudinal axis.

3. The shell and tube heat exchanger of claim 1, the shell further comprising a first end plate disposed at the first end of the shell, and a second end plate disposed at the second end of the shell.

* * * * *